US010306367B2

(12) United States Patent
Peterson et al.

(10) Patent No.: US 10,306,367 B2
(45) **Date of Patent: *May 28, 2019**

(54) ELECTRONIC DEVICES WITH MOTION-BASED ORIENTATION SENSING

(71) Applicant: Apple Inc., Cupertino, CA (US)

(72) Inventors: Jonathan R. Peterson, Los Gatos, CA (US); Daniel D. Sunshine, Sunnyvale, CA (US); Jahan C. Minoo, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/153,575

(22) Filed: Oct. 5, 2018

(65) Prior Publication Data

US 2019/0052965 A1 Feb. 14, 2019

Related U.S. Application Data

(63) Continuation of application No. 15/206,144, filed on Jul. 8, 2016, now Pat. No. 10,097,924.

(60) Provisional application No. 62/232,731, filed on Sep. 25, 2015.

(51) Int. Cl.

| | |
|---|---|
| ***H04R 1/10*** | (2006.01) |
| ***H04R 5/033*** | (2006.01) |
| ***H04R 5/04*** | (2006.01) |

(52) U.S. Cl.

CPC ..... *H04R 5/033* (2013.01); *H04R 1/1091* (2013.01); *H04R 5/04* (2013.01); *H04R 1/1041* (2013.01)

(58) Field of Classification Search

CPC ..... H04R 5/033; H04R 1/1091; H04R 5/04; H04R 1/1041

USPC ..... 381/123, 74, 309

See application file for complete search history.

(56) References Cited

U.S. PATENT DOCUMENTS

| | | | | |
|---|---|---|---|---|
| 8,831,242 | B2 | 9/2014 | Brown et al. | |
| 9,681,219 | B2 * | 6/2017 | Vilermo | H04R 1/32 |
| 2010/0246836 | A1 | 9/2010 | Johnson, Jr. et al. | |
| 2011/0119804 | A1 * | 5/2011 | Chiang | A61F 11/06 2/209 |

(Continued)

FOREIGN PATENT DOCUMENTS

| | | | | |
|---|---|---|---|---|
| JP | 2014045312 | * | 3/2014 | H04R 5/033 |

*Primary Examiner* — Vivian C Chin
*Assistant Examiner* — Ubachukwu A Odunukwe
(74) *Attorney, Agent, or Firm* — Treyz Law Group, P.C.; Kendall W. Abbasi

(57) ABSTRACT

An electronic device such as a pair of headphones may be provided with left and right speakers for playing audio to a user. Control circuitry in the electronic device may play audio through the speakers in an unreversed configuration in which left channel audio is played through a first of the speakers that is adjacent to a left ear of the user and right channel audio is played through a second of the speakers that is adjacent to a right ear of the user or a reversed configuration in which these channel assignments are reversed. A grip sensor may be used to distinguish between the user's left hand and the user's right hand. A motion sensor may detect movement as the headphones are placed on the user's head or on someone else's head. Control circuitry may use grip information and motion information to determine left and right channel assignments.

17 Claims, 8 Drawing Sheets

(56) References Cited

U.S. PATENT DOCUMENTS

| | | | | |
|---|---|---|---|---|
| 2011/0228950 | A1 | 9/2011 | Abrahamsson et al. | |
| 2012/0082321 | A1 | 4/2012 | Akaike et al. | |
| 2012/0114132 | A1 | 5/2012 | Abrahamsson et al. | |
| 2012/0229248 | A1 | 9/2012 | Parshionikar et al. | |
| 2013/0177166 | A1 | 7/2013 | Agevik et al. | |
| 2013/0279724 | A1* | 10/2013 | Stafford | H04R 1/1041 381/309 |
| 2014/0072136 | A1 | 3/2014 | Tenenbaum et al. | |
| 2016/0284436 | A1* | 9/2016 | Fukuhara | D03D 1/0088 |

* cited by examiner

ELECTRONIC DEVICES WITH MOTION-BASED ORIENTATION SENSING

This application is a continuation of patent application Ser. No. 15/206,144, filed Jul. 8, 2016, which claims the benefit of provisional patent application No. 62/232,731, filed Sep. 25, 2015, both of which are hereby incorporated by reference herein in their entireties.

BACKGROUND

This relates generally to electronic devices and, more particularly, to electronic devices such as headphones.

Electronic devices such as headphones may contain wireless circuitry for communicating with external equipment. The wireless circuitry may receive music and other audio content from remote equipment. The audio content can be played back to the user with speakers.

Audio content is often provided in a stereo format. Stereo audio has left and right channels. If care is not taken, a pair of headphones may be placed on a user's head in a reversed configuration. In the reversed configuration, left-channel stereo audio is played into the user's right ear and right-channel stereo audio is played into the user's left ear. This type of reversed audio may detract significantly from a user's experience. For example, if a user is watching accompanying video content, the reversed audio left-channel audio will not be properly synchronized with on-screen content, which can be disorienting for the user. A user may experience additional challenges when sharing headphones with another user. For example, a user may find it difficult to place headphones on another user's head without inadvertently reversing the left and right audio channels on the other user's ears.

It would therefore be desirable to be able to provide improved electronic devices such as stereo headphones.

SUMMARY

An electronic device such as a pair of headphones may be provided with left and right speakers for playing audio to a user. The left and right speakers may be housed in left and right portions of the headphones such as left and right ear cups.

Control circuitry in the electronic device may play audio through the speakers in an unreversed configuration in which left channel audio is played through a first of the speakers that is adjacent to a left ear of the user and right channel audio is played through a second of the speakers that is adjacent to a right ear of the user or a reversed configuration in which the right channel audio is played through the first speaker that adjacent to the left ear and the left channel audio is played through the second speaker that is adjacent to the right ear. A grip sensor formed from capacitive touch sensors, force sensors, and/or other sensors on the ear cups may measure finger grip patterns on the ear cups to determine whether to operate in the unreversed or reversed configuration.

A motion sensor may be used in conjunction with the grip sensor to help distinguish between unreversed and reversed orientations. The motion sensor may be used together with grip information to distinguish between a user placing headphones on his or her own head and the user placing headphones on another user's head. For example, upward motion may be indicative of a user placing headphones on his or her own head. An outward motion may be indicative of a user placing headphones on someone else's head. Using a grip sensor to distinguish a user's left hand from a user's right hand, control circuitry in the headphones may be able to characterize motion of the headphones as motion towards the user or motion away from the user. Control circuitry may then determine whether audio should be played in a reversed configuration or an unreversed configuration.

DETAILED DESCRIPTION

Figure 1:
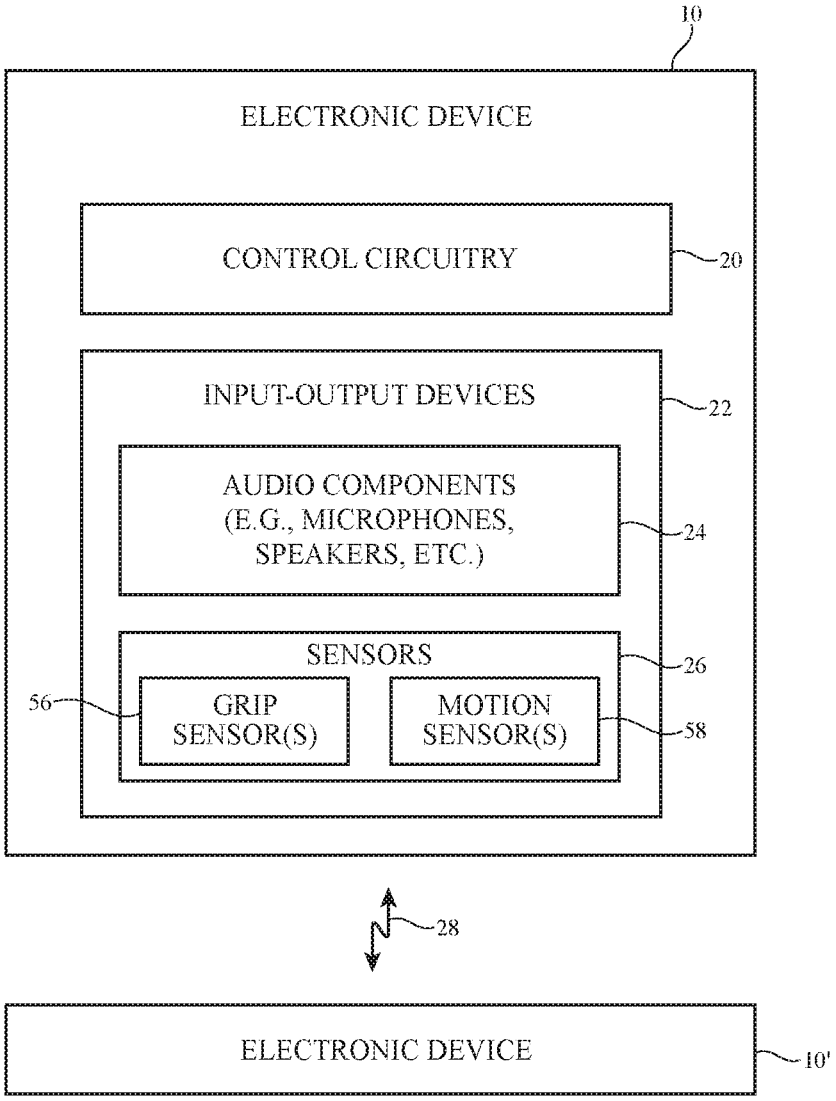
FIG. 1 is a schematic diagram of an illustrative electronic device in accordance with an embodiment.

An electronic device may be provided with sensors that monitor how the device is oriented relative to the body of a user. The sensors may, for example, include grip sensors that monitor how a user is holding a pair of headphones or other device. Motion sensors may be used to monitor how the pair of headphones or other device moves. Grip information and motion pattern information may be used to determine whether a user has placed the headphones on his or her own head or whether the user has placed the headphones on someone else's head. Based on this knowledge, the headphones or other electronic device can be configured appropriately. For example, left and right stereo headphone channel assignments may be placed in a normal or reversed configuration, and other device settings may be changed.

Touch sensor structures may be formed from thin layers of fabric, thin printed circuit substrates, and other thin layers of other material and may therefore sometimes be referred to touch sensor layers. The touch sensor layers in an electronic device may be formed on rigid substrates such as rigid printed circuit board layers and/or may be formed on flexible substrates (e.g., flexible printed circuit material such as flexible layers of polyimide or sheets of other flexible polymer material). In some configurations, touch sensor structures may be formed from printed coatings on a fabric or from conductive yarns or other strands of material in a fabric.

In general, the strands of material that form the fabric may be monofilaments, may be multifilament strands (sometimes referred to herein as yarns), may be formed from metal (e.g., metal monofilaments and/or yarns formed from multiple monofilament wires), may be formed from dielectric (e.g., polymer monofilaments and yarns formed from multiple polymer monofilaments), may include dielectric cores covered with conductive coatings such as metal (e.g., metal coated dielectric monofilaments and yarns of metal coated polymer-core monofilaments may be used to form conductive monofilaments and conductive yarns, respectively), may include outer insulating coatings (e.g., coatings of polymers or other dielectrics may surround each metal-clad polymer monofilament or each collection of metal-clad polymer monofilaments in a yarn, polymer insulation may enclose a multifilament metal wire, etc.), or may be other suitable strands of material for forming fabric. Configurations in which the fabric is formed from yarns (e.g., multifilament strands of material that are insulating or that contain metal wires and/or metal coatings on polymer monofilaments to render the yarns conductive) may sometimes be described herein as an example. This is, however, merely illustrative. The fabric may be formed using monofilaments, multifilament strands of material (yarns), combinations of these arrangements, etc. The fabric may be woven, knitted, braided, or may contain yarns or other strands of material that have been intertwined using other intertwining techniques. Touch sensor structures may be formed on the ear cups in a pair of headphones or on other portions of an electronic device.

FIG. 1 is a schematic diagram of an illustrative electronic device. As shown in FIG. 1, electronic device 10 may communicate wirelessly with external equipment such as electronic device 10' using wireless link 28. Wireless signals for link 28 may be light-based signals, may be acoustic signals, and/or may be radio-frequency signals (e.g., wireless local area network signals, Bluetooth® signals, radio-frequency signals in cellular telephone band, signals at 60 GHz, near field communications signals, etc.). Equipment 10 and equipment 10' may have antennas and wireless transceiver circuitry for supporting wireless communications over link 28. Equipment 10' may have the same capabilities as equipment 10 (i.e., devices 10 and 10' may be peer devices) or equipment 10' may include fewer resources or more resources than device 10.

Illustrative device 10 of FIG. 1 has control circuitry 20. Control circuitry 20 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 20 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 22 may be used to allow data to be supplied to device 10 and to allow data to be provided from device 10 to external devices. Input-output devices 22 may include buttons, joysticks, scrolling wheels, touch pads, key pads, keyboards, tone generators, vibrators, cameras, sensors 26 (e.g., ambient light sensors, proximity sensors, magnetic sensors, force sensors, touch sensors, accelerometers, and other sensors), light-emitting diodes and other status indicators, data ports, displays, etc. Input-output devices 22 may include audio components 24 such as microphones and speakers (e.g., left and right speakers in a pair of earbuds, in ear cups in over-the-ear headphones, in ear cups in on-the-ear headphones, or other earphones). A user can control the operation of device 10 by supplying commands through input-output devices 22 and may receive status information and other output from device 10 using the output resources of input-output devices 22.

Sensors 26 may include one or more grip sensors 56 and one or more motion sensors 58. Motion sensor 58 may include one or more accelerometers (e.g., accelerometers that measure acceleration along one, two, or three axes), gyroscopes, compasses, pressure sensors, other suitable types of motion sensors, etc. Storage and processing circuitry in device 10 (e.g., control circuitry 20) may be used to store and process motion sensor data gathered using motion sensor 58. If desired, the motion sensors, processing circuitry, and storage that form motion sensor 58 may form part of a system-on-chip integrated circuit (as an example). Motion sensor 58 may be used to continuously or periodically track movement of device 10.

Grip sensors 56 may include one or more touch sensors, force sensors pressure sensors, or other suitable sensor for detecting a user's hands and detecting how the user's hands grip device 10. This may include, for example, detecting points of contact between a user's fingers and device 10.

Control circuitry 20 may be used to run software on device 10 such as operating system code and applications. During operation of device 10, the software running on control circuitry 20 may use sensors 26 and other input-output devices 22 in device 10 to gather input from a user. A user may, for example, supply touch input using one or more fingers and/or other external objects (e.g., a stylus, etc.). Touch sensor input may also be gathered from touch sensors in contact with the ears of a user (or in contact with other body parts). This touch sensor input may help device 10 determine the orientation of device 10 with respect to the user's head or other body part. For example, by identifying which ear cup of a pair of headphones is covering the right ear of the user and which ear cup is covering the left ear, device 10 can determine whether the headphones are being worn in an unreversed or in a reversed configuration and can make audio adjustments accordingly (e.g., by adjusting left/right channel assignments).

Figure 2:
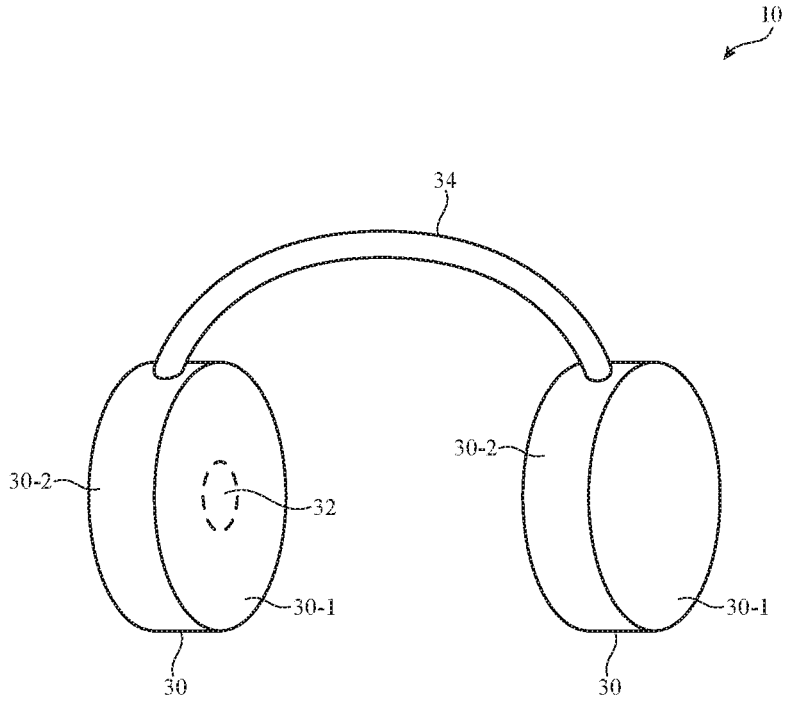
FIG. 2 is a perspective view of an illustrative electronic device such as a pair of headphones in accordance with an embodiment.

Electronic device 10 (and external equipment 10') may, in general, be any suitable electronic equipment. Electronic device 10 (and device 10') may, for example, be a computing device such as a laptop computer, a computer monitor containing an embedded computer, a tablet computer, a cellular telephone, a media player, or other handheld or portable electronic device, a smaller device such as a wristwatch device (e.g., a watch with a wrist strap), a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. FIG. 2 is a perspective view of an illustrative electronic device. In the illustrative configuration of FIG. 2, device 10 is a portable device such as a pair of headphones (earphones). Other configurations may be used for device 10 if desired. The example of FIG. 2 is merely illustrative.

As shown in FIG. 2, device 10 may have ear cups such as ear cups 30. There may be two ear cups 30 in device 10 that are coupled by a support such as band 34. Band 34 may be flexible and may have a curved shape to accommodate a user's head. There may be left and right ear cups 30 in device 10, one for one of the user's ears and the other for the other one of the user's ears. Each ear cup may have an area such as area 32 through which sound may be emitted from a speaker (e.g., a speaker system with one or more drivers). When worn in an unreversed configuration, the right ear cup of device 10 will supply audio to the right ear of the user and the left ear cup of device 10 will supply audio to the left ear of the user. In a reversed configuration, the right ear cup is adjacent to the user's left ear and the left ear cup is adjacent to the user's right ear. For correct audio playback, the assignment of the left and right channels of audio that are being played back to the user can be reversed (so that the left channel of audio is played through the right ear cup and vice versa) whenever device 10 is being worn in the reversed configuration. Unreversed right-left channel assignments may be used when device 10 is being worn in the unreversed configuration.

Device 10 may have an asymmetrical design or may have a symmetrical design. A symmetrical design may be used to provide device 10 with enhanced aesthetics. In some configurations for device 10 (e.g., when device 10 has a symmetrical design), there may be few or no recognizable differences between unreversed and reversed orientations for device 10. In this type of scenario, it may be desirable to use touch sensor input or input from other sensors 26 to determine whether to operate device 10 in an unreversed audio playback or reversed audio playback configuration.

To gather input from device 10, one or more of the external surfaces of band 34 and/or ear cups 30 may be provided with input-output devices 22 such as sensors 26. As an example, touch sensors or other sensors may be provided on inner ear cup surfaces 30-1, may be provided on opposing outer ear cup surfaces 30-3 (e.g., to gather input from a user's fingers or other external objects), and may be provided on the intermediate portions of the surfaces of ear cups 30 such as circumferential surfaces 30-2, which run around the periphery of cups 30 between inner surfaces 30-1 and outer surfaces 30-3 (e.g., to gather user grip information and other input).

Touch input to surfaces such as surfaces 30-1, 30-2, and/or 30-3 may include multi-touch input (e.g., simultaneous touch input from multiple locations), multi-touch gesture input and other gestures (e.g., swipes, finger pinches, taps, etc.), touch data associated with temporary contact with the user's fingers while ear cups 30 are being held by a user who is putting device 10 on the user's ears, touch data associated with the (potentially prolonged) contact between touch sensor arrays on inner surfaces 30-1 and the ears of the user, or other touch input. Non-touch input from a user and/or the environment surrounding device 10 may also be gathered using sensors 26.

Figure 3:
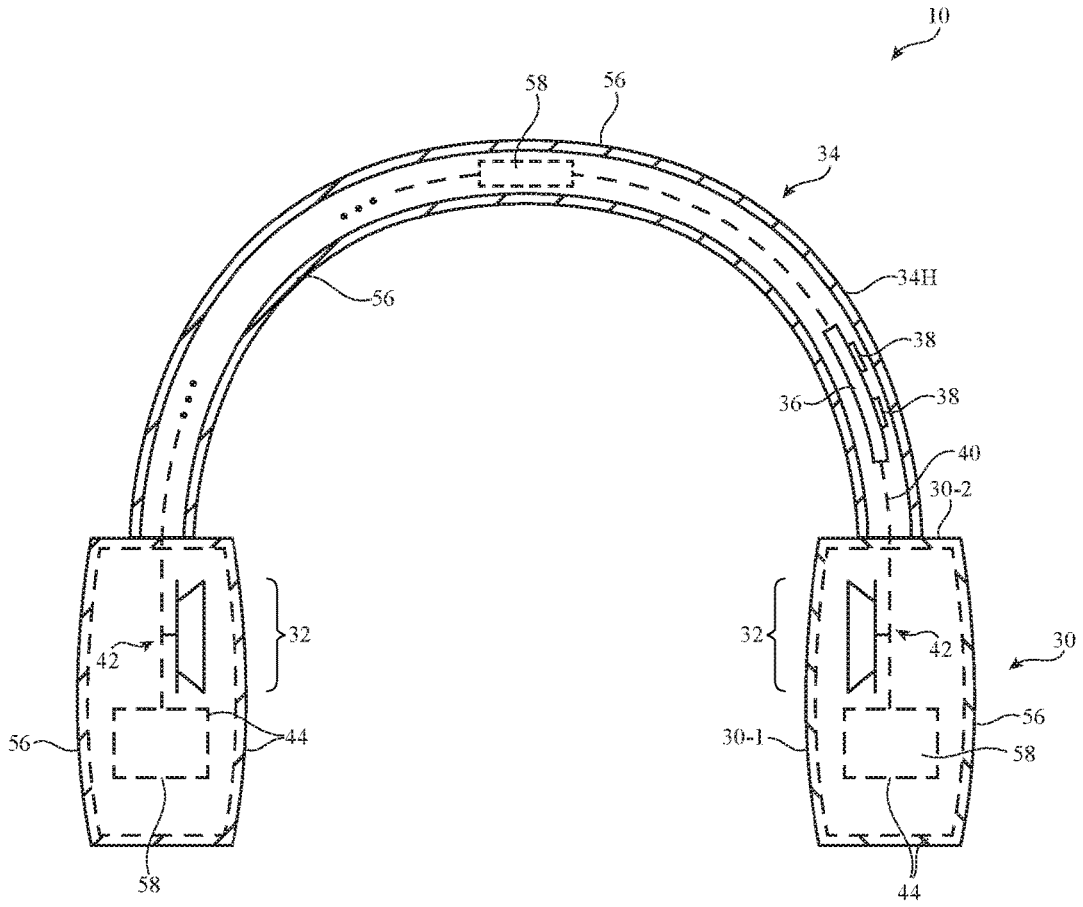
FIG. 3 is a cross-sectional side view of an illustrative electronic device in accordance with an embodiment.

A cross-sectional side view of device 10 of FIG. 2 is shown in FIG. 3. As shown in FIG. 3, band 34 may have band walls 34H (e.g., plastic walls, fabric walls, walls formed from metal or other materials, etc.). Electrical components 38 (e.g., control circuitry 20 and/or input-output devices 22, batteries, and/or other electrical circuitry) may be mounted on one or more substrates such as substrate 36 (e.g., a printed circuit such as a rigid printed circuit board formed from fiberglass-filled epoxy or other rigid printed circuit board material or a flexible printed circuit having a substrate formed from a flexible polymer such as a sheet of polyimide). Metal traces and other signal paths 40 may be used to couple circuitry 38 to sensor structures 44 on the surfaces of ear cups 30 and may be used to couple circuitry 38 to speakers 42. Each ear cup 30 may have a region such as region 32 through which sound is emitted from a corresponding speaker 42 while inner cup surfaces 30-1 are being worn against the user's head (e.g., on or over the user's ears). Region 32 may have an opening (e.g., a speaker port) and/or may be covered with an acoustically transparent material such as fabric, open cell foam, a metal or plastic structure with an array of openings, etc.

Sensor structures 44 may include grip sensor structures 56 and motion sensor structures 58. Grip sensor structures 56 may be formed on some or all of inner surfaces 30-1, outer surfaces 30-3, and intermediate surfaces 30-2 and may include touch sensors and other sensors 26. Grip sensor structures 56 may include touch sensor structures formed from yarns of conductive material (e.g. individual conductive yarns woven within a non-conductive fabric structure to form a capacitive touch sensor array), from conductive materials (e.g., conductive ink) that is printed in patterns on ear cups 30 (either directly on ear cups, or printed onto a laminate film/adhesive/intermediate layer that is then adhered to the ear cups), from metal traces on printed circuits and other substrates, from patterned metal foil, from metal housing structures and other metal parts, from non-metallic structures, and from other structures.

As shown in FIG. 3, motion sensors 58 may be located in ear cups 30 and/or band 34. If desired, motion sensors 58 may be located in both ear cups, may be located in only one ear cup, may be located only in band 34, or may be located both in band 34 and ear cups 30. Motion sensors 58 may include one or more gyroscopes, one or more accelerometers, and/or one or more other sensors for tracking motion of device 10.

Touch sensors in device 10 may be formed using any suitable touch technology. As an example, touch sensors may be formed from one or more patterned layers of capacitive touch sensor electrodes. Other types of touch sensor may be used in device 10 if desired (e.g., touch sensors based on resistive touch technology, acoustic touch technology, light-based touch sensors, etc.). In some scenarios, sensor arrays may be provided that are sensitive to the amount of force applied by a user's body part of other external object. This type of sensor may also gather information on the position of a user's finger or other external object (as with a touch sensor) but is sometimes referred to as a force sensor because not all touch sensors are sensitive to different amounts of applied force.

If desired, hybrid sensors may be provided. A hybrid sensor may gather input using multiple different sensor technologies. An example of a hybrid sensor that may be used in gathering input for device 10 is a hybrid capacitive touch-force sensor. This type of sensor may make capacitive measurements to determine where a user's touch input is being provided (e.g., to gather touch location information) and may make a different type of capacitive measurements to determine how forcefully the user's touch input is being applied (e.g., to gather force input).

Figure 4:
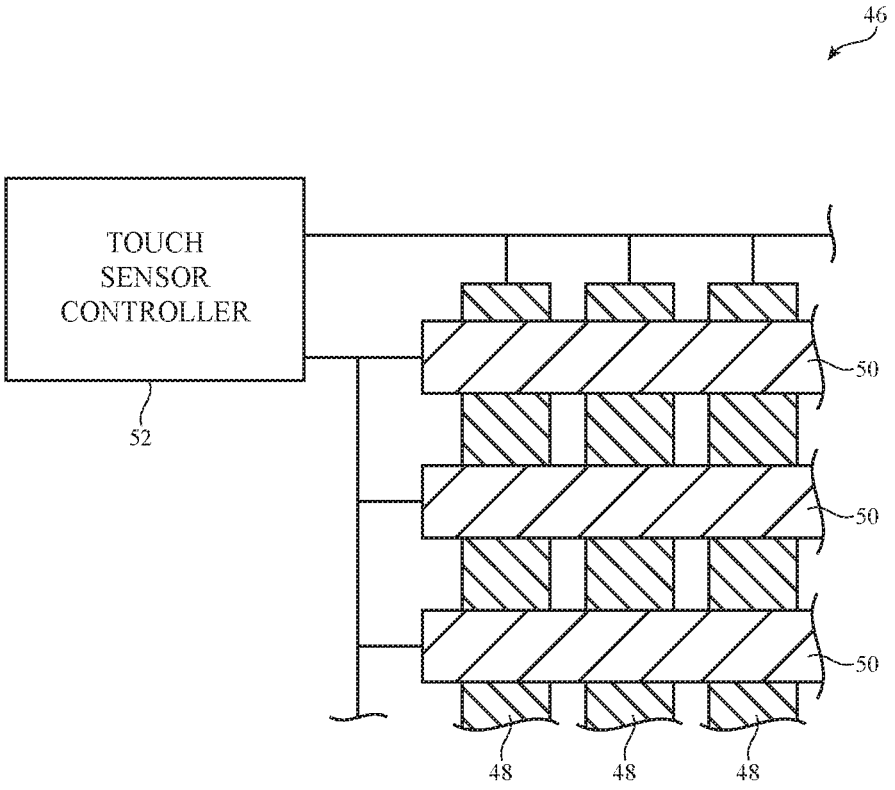
FIG. 4 is a diagram of an illustrative capacitive touch sensor in accordance with an embodiment.

An illustrative capacitive touch sensor array is shown in FIG. 4. Touch sensor 46 of FIG. 4 is a capacitive touch sensor having touch sensor electrodes 48 and 50. Touch sensor controller 52 may supply drive signals to the touch sensor electrodes while gathering corresponding sense signals from the electrodes. Using this type of arrangement or other touch controller arrangement, controller 52 may make capacitance measurements with electrodes 48 and 52 that allow controller 52 to determine the location of a user's touch within the electrodes (e.g., that allow controller 52 to identify the location at which the presence of the user's finger or other body part overlaps the array and therefore creates a localized reduction in electrode-to-electrode capacitance).

Electrodes 48 and 50 may be formed from transparent conductive material such as indium tin oxide or invisibly thin conductive lines or from opaque materials such as metal. Electrodes 48 and 50 may be formed on one side or on opposing sides of a flexible printed circuit, may be formed as multiple layers in a touch sensor coating formed on a fabric or foam layer or other structures in device 10, may be formed using single-sided electrode patterns, may be formed using double-sided electrode patterns, may be formed from conductive strands of material (e.g., dielectric yarns coated with a conductive material and, if desired, an outer coating of dielectric material, metal yarns of conductive material, etc.), may be formed using patterns of interconnected squares, diamonds, wedges, dots, or other capacitive electrode shapes, may have circular electrode shapes, may have curved shapes (e.g., full or partial ring shapes), may have radially symmetric shapes and/or rotationally symmetric shapes, or may be formed using any other suitable touch sensor configuration. The configuration of FIG. 4 in which sets of perpendicular touch sensor capacitive electrode strips are arranged in a grid of overlapping horizontal and vertical electrodes is merely illustrative.

If desired, an array of conductive paths for a capacitive touch sensor electrode grid or other conductive structures in device 10 may be formed using conductive yarns (or other conductive strands of material) to form a fabric-based grip sensor. Grip sensor 56 may, if desired, include force sensing components. For example, grip sensor 56 may include a layer of compressible material such as polymer foam, fabric, or other material that can be compressed when force is applied. Capacitor electrodes may be formed on opposing surfaces of the compressible material. When an external object such as a user's finger, palm, or ear presses against the compressible material, a change in capacitance proportional to the amount of force applied by the object may be detected. The output of the force sensor may also contain position information so that the force sensor can also serve as a position sensor that senses where a user is applying force to electronic device 10.

If desired, grip sensor 56 on ear cups 30 may include an array of capacitive touch sensor electrodes (or other touch sensor elements) that extend around peripheral surface 30-2 of each ear cup 30. The electrodes may be used to form a touch sensor that measures the position of a user's hand on cups 30. Touch sensors may also be formed from arrays of electrodes on inner cup surfaces such as surface 30-1 and outer cup surface 30-3. If desired, the touch sensor on outer cup surface 30-3 and/or cup surface 30-2 may be used to gather touch input from the user's finger or other external object. If desired, grip sensor 56 may be a touch sensor, a force sensor, a hybrid touch-force sensor, or other sensor.

Figure 5:
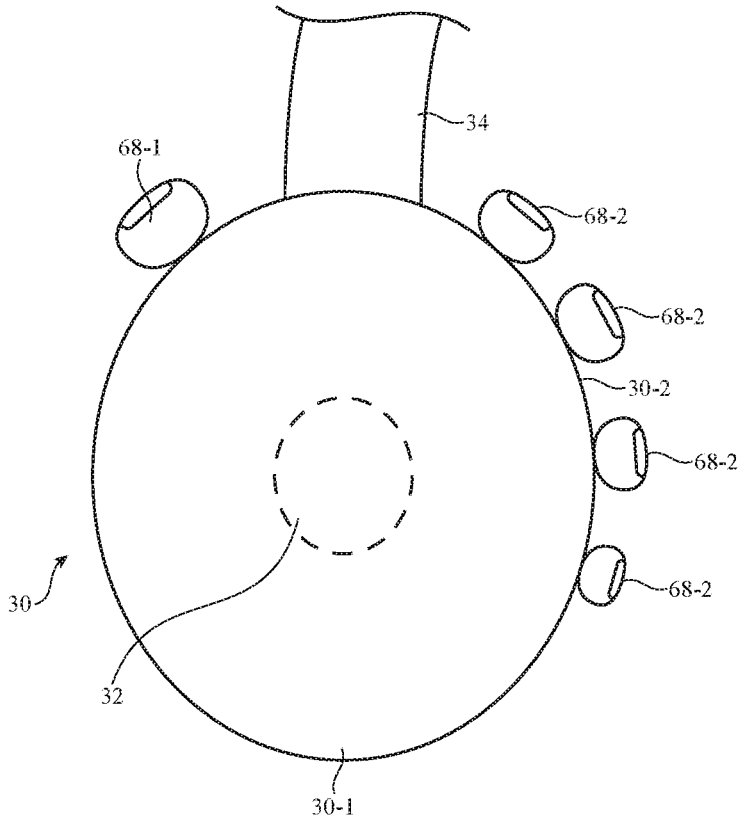
FIG. 5 is a side view of a portion of an illustrative electronic device of the type shown in FIG. 3 in which a sensor is being used to detect a user's grip on the headphone by analyzing the pattern of finger contacts between the user's fingers and thereby discriminating between left-hand and right-hand grip patterns in accordance with an embodiment.

Using touch sensor 56 or other sensor on surface 30-2, device 10 may monitor a user's fingers. When a user grips an ear cup, the user's thumb (finger 68-1 of FIG. 5) will generally be positioned on an opposing side of surface 30-2 from the user's other fingers (fingers 68-2). By detecting the number of fingers in each location and by identifying the grip pattern of FIG. 5 (thumb 68-1 on one side and fingers 68-2 on the other), device 10 can detect whether a user has picked up each cup 30 with a left or right hand. Based on this information (i.e., by analyzing the touch input gathered by sensor 30-2 around the periphery of cup 30 to discriminate between left and right hand (finger) grips), device 10 can determine whether device 10 is being mounted on the user's head in an unreversed configuration or a reversed configuration. When the user's right hand is detected on the right ear cup and the user's left hand is detected on the left ear cup, device 10 may conclude that the user is holding device 10 in a way that allows the user to place the right cup over the right ear and the left cup over the left ear (i.e., device 10 will be used in the normal unreversed configuration). When the opposite pattern is detected (right hand grip on left cup and left hand grip pattern on the right cup), device 10 may conclude that the right and left cups will be reversed and that device 10 will be placed on the user's head in a reversed configuration. If desired, additional data from sensors 26 may be used in determining device orientation. The use of hand grip patterns to discriminate between unreversed and reversed orientations for device 10 is merely illustrative.

In some situations, grip detection alone may not be sufficient to determine whether device 10 is placed on the user's head in a reversed or unreversed configuration. For example, a user may hold a pair of headphones in an unreversed configuration, but when the user places the pair of headphones on another user's head, the headphones may be in a reversed configuration. Since the grip of a user's hands tends to be the same for placing the headphones on his or her own head and for placing the headphones on someone else's head, grip detection alone may, in some situations, be unable to distinguish between reversed and unreversed configurations.

If desired, motion sensor 58 may be used in conjunction with grip sensor 56 to help distinguish between unreversed and reversed orientations. Motion sensor 58 may, for example, gather motion sensor data indicating how device 10 moves in space. Certain movements may be characteristic of a user placing device 10 on his or her own head. Other movements may be characteristic of a user placing device 10 on another user's head. Based on this information and information from grip sensor 56, control circuitry 20 may determine whether device 10 is reversed or unreversed on a user's head and may assign left/right audio channels accordingly. If desired, control circuitry 20 may rely solely on grip information from grip sensor 56 or may rely solely on motion information from motion sensor 58 to determine left/right channel assignments. The use of motion information and grip information is sometimes described as an illustrative example.

Figure 6:
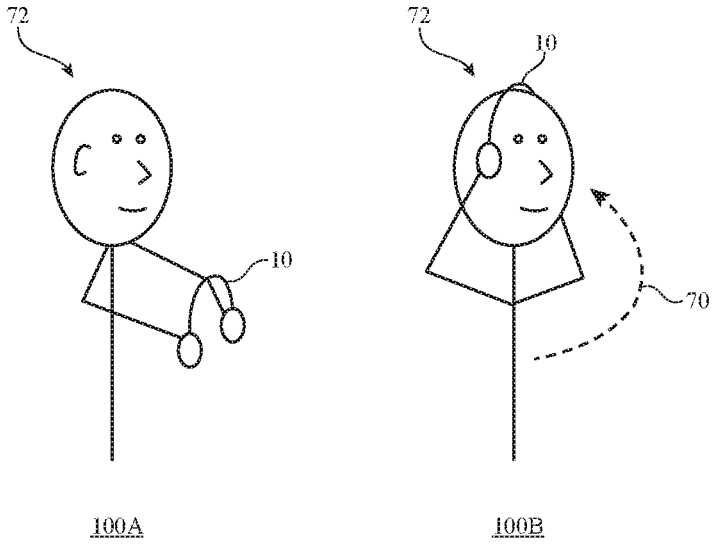
FIG. 6 is a diagram illustrating how headphones follow an upward motion path when a user places the headphones on his or her own head in accordance with an embodiment.

FIG. 6 is a diagram illustrating how a certain movement of device 10 can be indicative of a user placing device 10 on his or her own head. In initial position 100A, user 72 may hold device 10 in front of his or her body, below head level. In position 100B, user 72 has moved device 10 from lowered position 100A to on-ear position 100B. In moving from lowered position 100A to on-ear position 100B, device 10 may follow un upward arc such as upward arc motion path 70.

Motion sensor 58 may gather motion data as device 10 moves along upward arc 70. This information may be combined with grip information to determine whether device 10 is in a reversed or unreversed configuration. For example, when grip sensor 56 detects the right hand of user 72 on the right ear cup and the left hand of user 72 on the left ear cup of device 10 and when motion sensor 58 detects upward motion path 70, device 10 can conclude that user 72 is holding device 10 in a way that allows user 72 to place the right cup over his or her right ear and the left cup over his or her left ear (i.e., device 10 will be used in the normal unreversed configuration). When the opposite pattern is detected (right hand grip on left cup and left hand grip pattern on the right cup), device 10 can conclude that the right and left cups will be reversed and that device 10 will be placed on the user's head in a reversed configuration.

Figure 8:
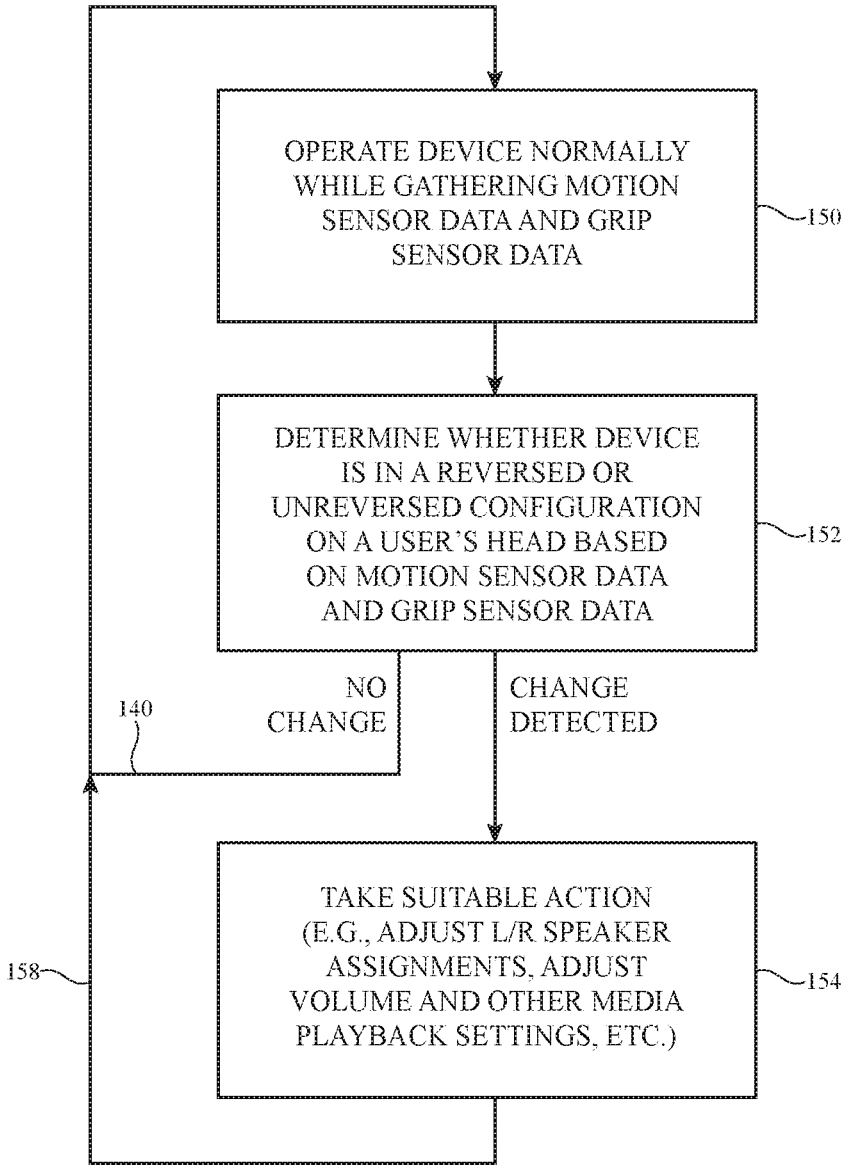
FIG. 8 is a flow chart of illustrative steps involved in operating an electronic device such as a pair of headphones having sensor structures in accordance with an embodiment.

FIG. 8 is a diagram illustrating how a certain movement of device 10 can be indicative of a user placing device 10 on someone else's head. In initial position 200A, user 72 may hold device 10 in front of his or her body, below head level. In position 200B, user 72 has moved device 10 from lowered position 200A to on-ear position 200B on user 74. In moving from lowered position 200A to on-ear position 200B, device 10 may follow un outward arc such as outward arc motion path 76 as it moves from user 72 to user 74.

Motion sensor 58 may gather motion data as device 10 moves along outward arc 76. This information may be combined with grip information to determine whether device 10 is in a reversed or unreversed configuration. For example, when grip sensor 56 detects the user's right hand on the right ear cup and the user's left hand on the left ear cup and when motion sensor 58 detects outward motion path 76, device 10 can conclude that user 72 is holding device 10 in a way that allows user 72 to place the right cup over the left ear of user 74 and the left cup over the right ear of user 74 (i.e., device 10 will be used in a reversed configuration). When the opposite pattern is detected (right hand grip on left cup and left hand grip pattern on the right cup), device 10 can conclude that the right and left cups will be in a normal unreversed configuration on the head of user 74.

FIG. 8 is a flow chart of illustrative steps involved in operating device 10. As shown in FIG. 8, device 10 (and, if desired, external equipment 10') may be operated normally at step 150 while gathering sensor data. For example, equipment 10' may stream wireless audio content to device 10 while playing corresponding video or other content on a display or other output device. Device 10 may receive the wirelessly transmitted audio and may play the audio to a user through speakers 42 (FIG. 3). Before playing the audio and/or while playing audio, device 10 may gather sensor data from touch sensors, force sensors, hybrid touch-force sensors, motion sensors or other sensors in device 10. For example, control circuitry 20 may gather grip information from grip sensor 56 and motion information from motion sensor 58.

Figure 7:
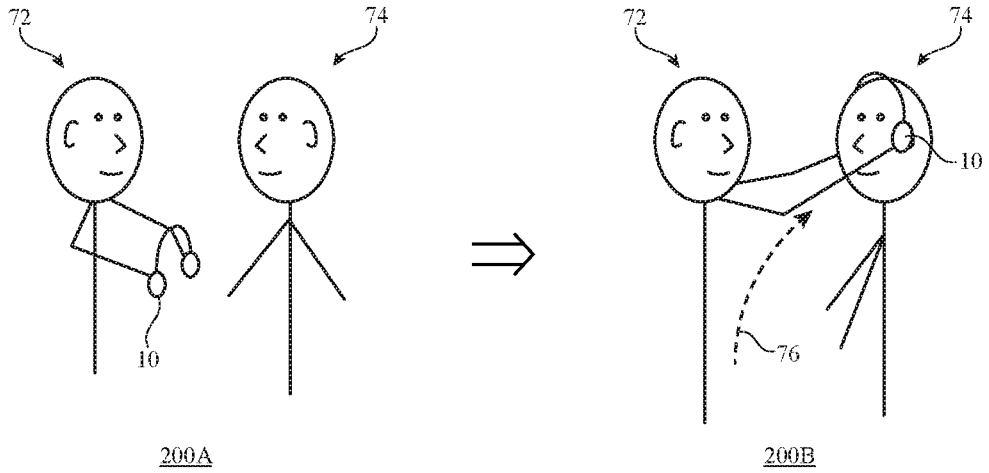
FIG. 7 is a diagram illustrating how headphones follow an outward motion path when a user places the headphones on someone else head in accordance with an embodiment.

At step 152, control circuitry 20 in device 10 and, if desired, control circuitry in device 10' may analyze the sensor data to determine whether device 10 is in a reversed or unreversed configuration on a user's head. For example, the sensor data from grip sensor 56 may be analyzed to determine which of the user's hands is gripping each ear cup 30. Sensor data from motion sensor 58 may be analyzed to determine whether the movement of device 10 is indicative of device 10 being placed on the user's own head or on someone else's head (e.g., based on grip information and based on whether device 10 follows an upward motion path such as path 70 of FIG. 6 or an outward motion path such as path 76 of FIG. 7). This information may in turn be used to determine the orientation (unreversed or reversed) of device 10 relative to the user's ears and head.

If no desired change in operation is detected at step 152 (e.g., if device 10 is oriented as expected on the user's head), processing may loop back to step 150, as indicated by line 140.

If, however, it is determined that device 10 is being worn in a way that requires a change in operation for device 10 or device 10' (e.g., if it is determined that device 10 is being worn in a reversed configuration), device 10 and, if desired, device 10' can take suitable actions in response at step 154. During the operations of step 154, device 10 can reverse audio playback so that right and left channel assignments are reversed to accommodate a reversed orientation for device 10 on the user's head, may make adjustments to media playback settings (in device 10 and/or device 10') and can otherwise adjust the operation of device 10 and device 10. Media playback adjustments made by control circuitry 20 may include adjusting equalizer settings, changing volume level, etc. Operations can then loop back to step 150, as indicated by line 158.

The foregoing is merely illustrative and various modifications can be made by those skilled in the art without departing from the scope and spirit of the described embodiments. The foregoing embodiments may be implemented individually or in any combination.

What is claimed is:

1. An electronic device that provides audio to a user, comprising:

ear cups containing speakers;

a grip sensor on each ear cup that detects locations of the user's fingers on each ear cup;

a motion sensor that detects a motion path of the ear cups relative to the locations of the user's fingers, wherein the motion sensor comprises an accelerometer; and control circuitry that plays audio through the ear cups in accordance with left and right channel assignments, wherein the control circuitry determines the left and right channel assignments based on the motion path of the ear cups relative to the locations of the user's fingers.

2. The electronic device defined in claim 1 wherein the grip sensor detects touch input from the user's fingers.

3. The electronic device defined in claim 2 wherein the touch input comprises multi-touch gesture input.

4. The electronic device defined in claim 2 wherein the touch input comprises tap input.

5. The electronic device defined in claim 1 wherein the ear cups comprise fabric.

6. The electronic device defined in claim 5 wherein the grip sensor is formed from conductive yarns in the fabric.

7. The electronic device defined in claim 6 wherein the conductive yarns form a capacitive touch sensor array.

8. The electronic device defined in claim 1 wherein the control circuitry is configured to:

play the audio in accordance with a first left and right channel assignment when the motion path is in a first direction relative to the locations of the user's fingers; and play the audio in accordance with a second left and right channel assignment when the motion path is in a second direction relative to the locations of the user's fingers.

9. The electronic device defined in claim 8 wherein the first left and right channel assignment is an unreversed channel assignment and the second left and right channel assignment is a reversed channel assignment.

10. Headphones that play audio for a user, comprising:

left and right ear cups having respective left and right speakers with which the audio is played;

capacitive sensors on the left and right ear cups that receive user input from the user's fingers, wherein the capacitive sensors sense finger positions on the left and right ear cups as the user grips the ear cups;

a motion sensor that detects a motion path of the headphones, wherein the motion sensor comprises an accelerometer; and control circuitry that:

determines left and right channel assignments based on the sensed finger positions and the motion path; and adjusts a volume of the audio in response to the user input from the user's fingers.

11. The headphones defined in claim 10 wherein the control circuitry is configured to:

play the audio in accordance with a first left and right channel assignment when the motion path is in a first direction relative to the sensed finger positions; and play the audio in accordance with a second left and right channel assignment when the motion path is in a second direction relative to the sensed finger positions.

12. The headphones defined in claim 10 wherein the left and right ear cups comprise fabric.

13. The headphones defined in claim 12 wherein the capacitive sensors comprise conductive yarns in the fabric.

14. Earphones that play audio for a user, comprising:

left and right speaker housings having respective left and right speakers with which the audio is played;

touch sensors on the left and right speaker housings that detect locations of the user's fingers on the left and right speaker housings;

a motion sensor that detects movement of the earphones; and control circuitry that determines left and right channel assignments based on the locations of the user's fingers and based on the movement of the earphones, wherein the control circuitry is configured to:

play the audio in accordance with an unreversed channel assignment when the movement is in a first direction relative to the locations of the user's fingers; and play the audio in accordance with a reversed channel assignment when the movement is in a second direction relative to the locations of the user's fingers.

15. The earphones defined in claim 14 wherein the touch sensors comprise capacitive touch sensors.

16. The earphones defined in claim 15 wherein the left and right speaker housings comprise fabric.

17. The earphones defined in claim 16 wherein the touch sensors comprise conductive yarns in the fabric.

* * * * *